US008656514B2

(12) United States Patent
Neuron

(10) Patent No.: US 8,656,514 B2
(45) Date of Patent: Feb. 25, 2014

(54) PADDING SYSTEM

(75) Inventor: Eric P. Neuron, Carpinteria, CA (US)

(73) Assignee: Patagonia, Inc., Ventura, CA (US)

( * ) Notice: Subject to any disclaimer, the term of this patent is extended or adjusted under 35 U.S.C. 154(b) by 219 days.

(21) Appl. No.: 13/156,135

(22) Filed: Jun. 8, 2011

(65) Prior Publication Data

US 2012/0311755 A1 Dec. 13, 2012

(51) Int. Cl.
*A41D 13/06* (2006.01)
*A41D 1/08* (2006.01)

(52) U.S. Cl.
USPC ..... 2/23; 2/24; 2/227; 2/267

(58) Field of Classification Search
USPC ..... 2/23, 24, 267, 268, 247, 249, 250, 251, 2/20, 459, 464, 465, 466, 16, 22, 227, 2/228, 231, 455, 456, 463
See application file for complete search history.

(56) References Cited

U.S. PATENT DOCUMENTS 759,765 A * 5/1904 Stall ..... 2/23
907,050 A * 12/1908 Hestness ..... 2/23
932,990 A * 8/1909 Madill et al. ..... 2/227
1,669,085 A * 5/1928 Guyon ..... 2/23
1,792,048 A 2/1931 Swenson
1,857,850 A * 5/1932 Jones ..... 2/23
1,944,127 A * 1/1934 Jones ..... 2/23
2,093,888 A 9/1937 Holtje
2,195,817 A 4/1940 Johnson
2,561,872 A * 7/1951 Krinick ..... 2/24
4,688,269 A * 8/1987 Maeshima ..... 2/456
5,105,473 A * 4/1992 Valtakari ..... 2/461
5,557,804 A * 9/1996 Ovortrup et al. ..... 2/23
6,014,771 A 1/2000 Kirven
6,317,888 B1 11/2001 McFarlane
6,854,129 B2 * 2/2005 Mazzarolo ..... 2/23
6,988,281 B1 1/2006 Jerome et al.
7,089,598 B2 8/2006 Sallas et al.
7,237,270 B2 7/2007 Crye et al.
7,296,301 B1 11/2007 Conn
D602,210 S 10/2009 Crye
2006/0005292 A1 1/2006 Crye et al.
2008/0222767 A1 9/2008 Williams
2008/0289072 A1 * 11/2008 Shin ..... 2/23
2009/0083901 A1 4/2009 Pardillo et al.
2009/0299244 A1 12/2009 Chiang et al.
2010/0235960 A1 9/2010 Johnson
2012/0131729 A1 * 5/2012 Hernandez ..... 2/410

* cited by examiner

*Primary Examiner* — Amy Vanatta
(74) *Attorney, Agent, or Firm* — Lowe Graham Jones PLLC

(57) ABSTRACT

A padding system may be advantageously modular in terms of size and shape, easily removable and replaceable, and comfortable and secure while maintaining an aesthetically neat and trim look. In one embodiment, the padding system includes an inner pad coupled to an outer shell with a portion of an apparel article positioned between, The apparel may include openings to allow a direct connection between the inner pad and outer shell or fasteners may be attached to the apparel for removably engaging with one or both of the inner pad and outer shell. The inner pad may be received in a pocket, which may extend inward or outward.

20 Claims, 9 Drawing Sheets

PADDING SYSTEM

FIELD OF THE INVENTION

This invention relates generally to a pad system, and more specifically to a removable and modular pad system usable in a variety of environments such as military, police, recreational shooting, recreational outdoor activities, construction, and home improvement.

BACKGROUND OF THE INVENTION

Conventional knee pads are available in two types: soft shell and hard shell. Volleyball players, for example, use soft knee pads that attach with elastic straps. Hard shell knee pads generally include a soft inner pad fixed to a hard outer pad of material having a higher density (i.e., the hard shell). Like the soft shell knee pads, the most hard shell knee pads are attachable to the wearer using elastic straps. If the straps are permanently attached to the knee pad system then it is worn by sliding it over the foot and up to the knee. Otherwise, the straps may be attached using clips, buckles or a hook-and-loop fastening system (e.g., a VELCRO® fastening system). The pads may be worn under or over pants.

After so much movement like walking or running, the strap-style knee pads often begin to fall or at least move with respect to the knee, thus requiring effort to pull the knee pad back up or to adequately reposition it. In some environments such as a military combat situation, a soldier's split second movement to pull up his knee pad could give away his position or provoke even harsher consequences. In other, less dangerous, environments the pulling up or repositioning of strap-style knee pads can just be irritating. Protective pads that are not in the proper place may also not provide adequate protection. The pads and straps can also bind or chafe the knee or leg making the pads uncomfortable to wear.

One type of knee pad system provides for the knee pad to be sewn into the apparel, which essentially results in a non-removable knee pad. One drawback of such a permanent assembly is that in many activities the wearer may perspire, which in turn generates moisture that is absorbed by the knee pad. The moist knee pad may then become heavier and less comfortable. Closed-cell pads have been developed for use with pants and may be insertable into a knee pocket in the pants. However, these pads do not prevent excessive wear on the outer layer of the pants and may even accelerate the wear of the pant knees.

These same basic considerations apply to elbow pads, hip pads, and other protective pads.

SUMMARY OF THE INVENTION

The present invention relates to a padding system that may advantageously provide the benefits of being modular in terms of size and shape, easily removable and replaceable, comfortable and secure all while maintaining an aesthetically, orderly, or neat and trim look. These advantages, and in particular the latter advantage, make the padding system beneficial to and desirable for military and police units. In one embodiment, the padding system is a knee pad system having an inner knee pad and an outer shell fastened to one another through openings provided in a trouser fabric located between the inner knee pad and the outer shell. The inner knee pad may be received in a pocket coupled to the trouser fabric.

In accordance with an aspect of the invention, a padding system includes an inner pad; a fastening assembly; and an outer shell removably attachable to one of an apparel item or the inner pad by way of the fastening device.

In accordance with another aspect of the invention, a padding system for an apparel item includes a pocket coupled to a surface of the apparel item; an inner pad receivable in the pocket; and an outer shell removably attachable to the inner pad by way of openings provided in either the apparel item or the pocket.

In accordance with yet another aspect of the invention, a pair of trousers includes a knee portion coupled to the trousers; a pocket coupled to the knee portion; an inner knee pad receivable in the pocket; and an outer shell removably attachable to the inner knee pad by way of openings provided in one of the knee portion or the pocket.

In accordance with yet another aspect of the invention, a method for coupling a padding system to an apparel item includes the steps of (1) sliding an inner pad into a pocket coupled to the apparel item, the inner pad having a fastening device; (2) arranging the inner pad in the pocket to align the fastening device with an opening formed in either one of the pocket or the apparel item; and (3) coupling an outer shell to the inner pad using a complementary fastening device that is engageable with the fastening device of the inner pad.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

As will be described in further detail below, an embodiment of the present invention includes a padding system having an outer shell coupled to an inner pad that is received in a pocket coupled to an article of apparel, such as a trouser leg or a shirt sleeve, which may be made from a natural cloth, synthetic, laminate or other type of material. The pocket may extend inwardly or outwardly from a portion of the apparel. Thus, either the pocket or the trouser leg includes openings that permit fasteners on the outer shell to be coupled to fasteners on the inner pad. In at least one embodiment, these openings are covered by the outer shell when attached to the inner pad, which in turn provides a clean, aesthetic appearance. Alternatively, the fasteners may not extend through openings, but be secured with magnets or to the apparel directly with other fasteners, while still generally aligning the shell over the pad. The pad may fit snuggly within the pocket created in the apparel for it, while the shell is securable to the outer layer of the apparel to be positioned directly over the pad. Alternatively, the pad may simply be disposed inside the apparel with the shell on the outside, without the pad being secured within a pocket. The securement of the shell to the pad situates the pad in this embodiment. This system and its various alternate embodiments may be applied to a knee pad, an elbow pad, a hip pad, or other protective gear used in conjunction with apparel. For purposes of brevity and clarity, the description here will focus on a knee pad embodiment as set forth below.

Figure 1:
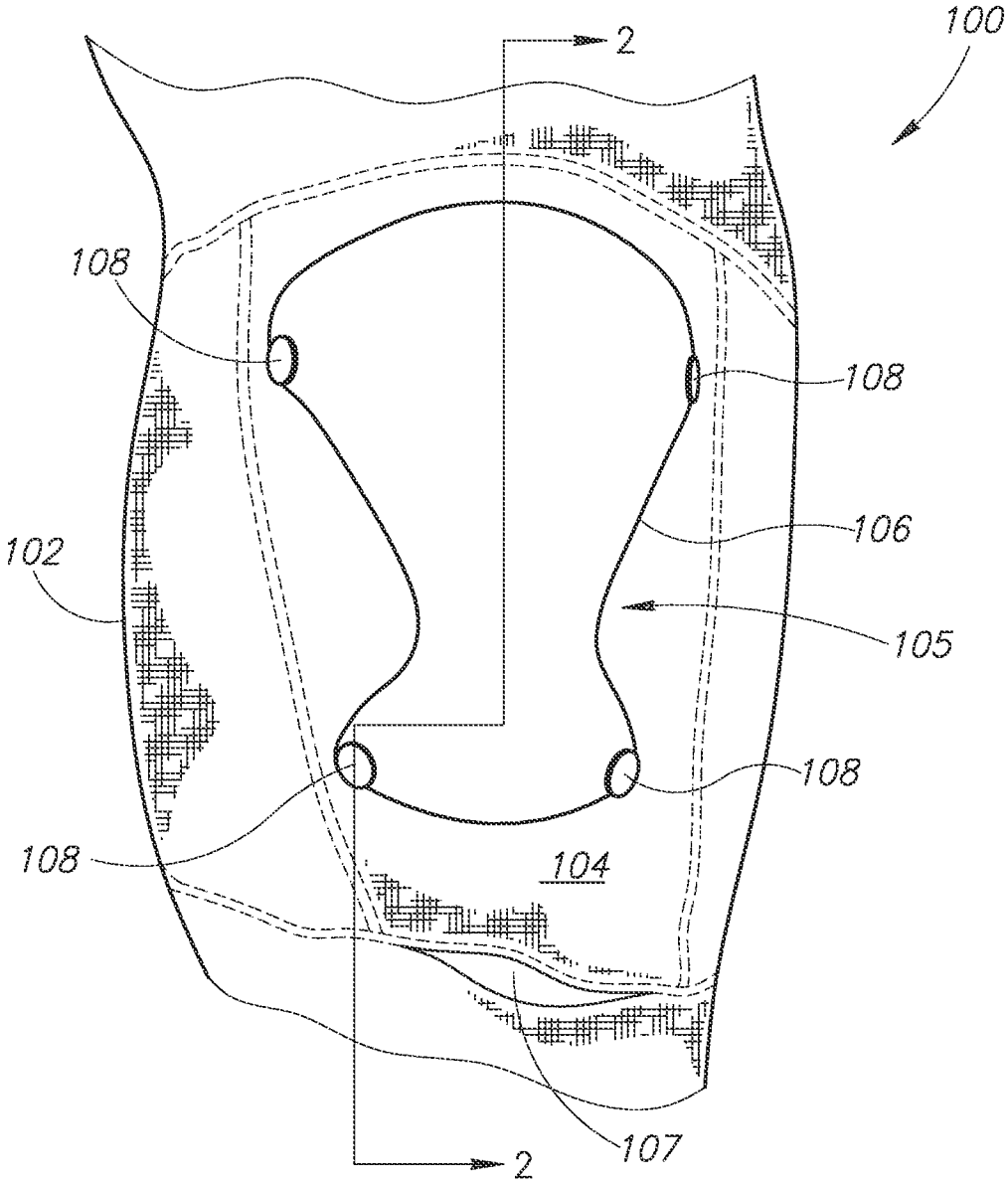
FIG. 1 is a front perspective view of a padding system according to an embodiment of the present invention.

FIG. 1 shows a portion of a pair of trousers 100 having a trouser leg 102 with a trouser knee portion 104 integrally formed therewith or attached thereto. A knee pad system 105 is attached to the knee portion 104. The illustrated embodiment shows an outer shell 106 having fasteners 108, which take the form of snaps in this embodiment. The knee portion 104 is configured with an opening 107 configured to receive an inner pad (not shown), as will be described in greater detail below. However, the fasteners 108 may take other forms such as, but not limited to, hook and loop fasteners or clips. The trousers may otherwise be referred to as or take the form of fatigues, slacks, jeans, denims, dungarees, overalls, corduroys, or chaps. Fatigues may have different names depending on the type of service or unit, for example the U.S. Army calls them army combat uniforms (ACUs). As mentioned above, the padding system may be used with apparel on other parts of the body as well, such as elbows or hips. The double-dashed lines in FIG. 1 show stitching on the trousers 100.

Figure 2:
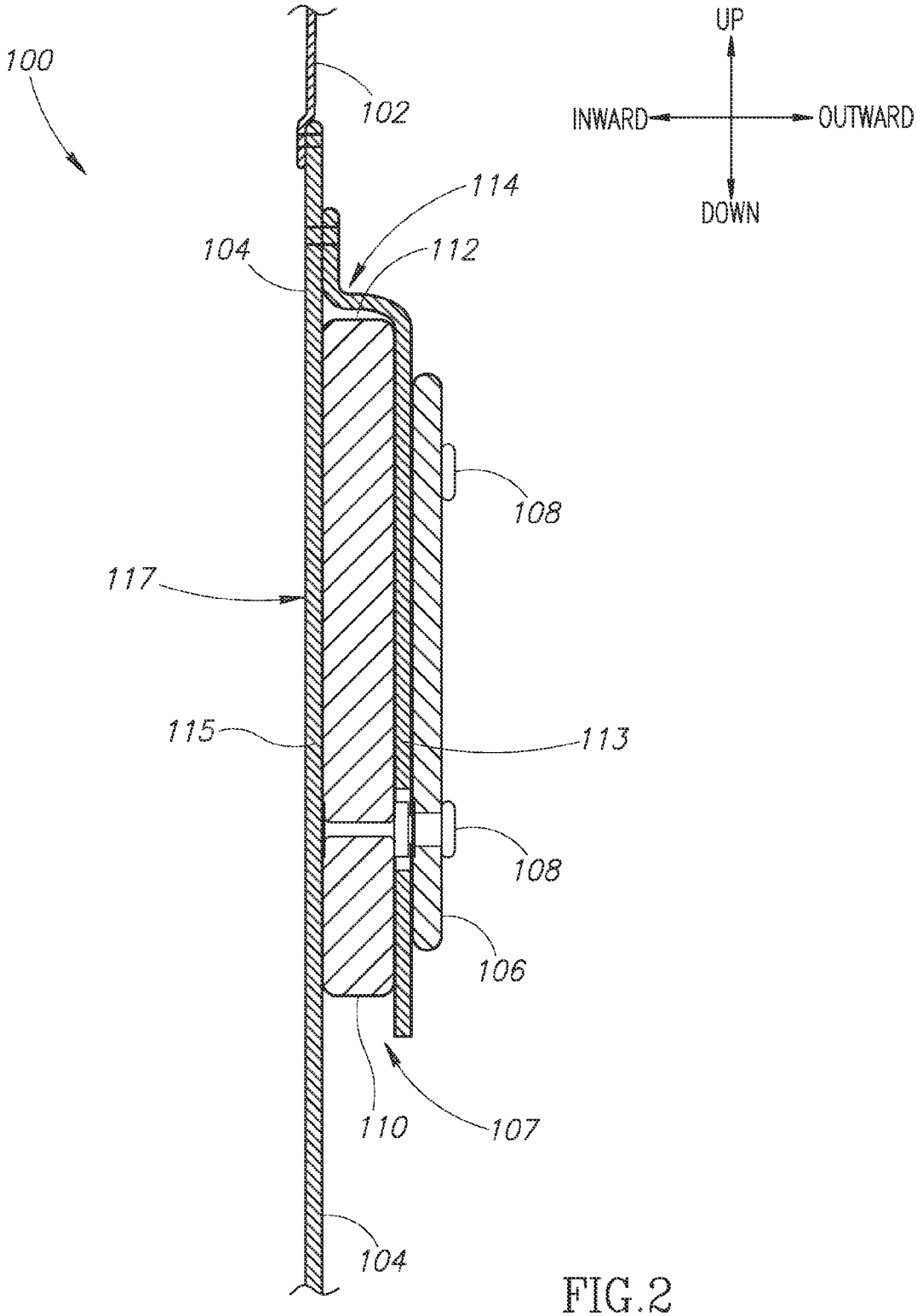
FIG. 2 a cross-sectional view of the padding system of FIG. 1 taken along line 2-2 of FIG. 1 according to an embodiment of the present invention.

FIG. 2 shows the outer shell 106 fastened to an inner pad 110, which in turn is received in a space 112 formed by a pocket 114 coupled to the knee portion 104. The inner pocket 114 may be stitched to or otherwise attached to the knee portion 104. The inner pocket 114 is defined by an interfacing pocket portion 113 and a region 115 of the knee portion 104 that cooperate to form the space 112. In the illustrated embodiment, the pocket 114 is formed on or attached to an exterior surface of the trousers 100. Therefore, the inner pad 110 contacts both the interfacing pocket portion 113 and the region 115, which is not visible when the outer shell 106 is removed. The region 115 includes a surface 117 in contact with the wearer; whereas the interfacing pocket portion 113 is trapped between the outer shell 106 and the inner pad 110. The pocket opening is provided near a lower section of the knee portion 104 such that the inner pad 110 is inserted into the pocket opening 107 by pushing it upwards into the pocket 114.

Figure 4:
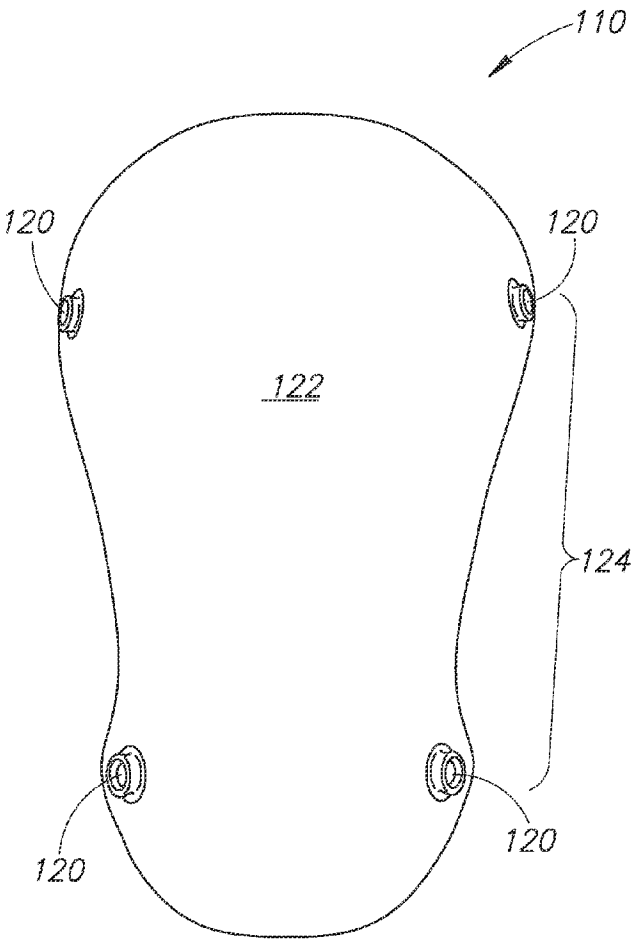
FIG. 4 is a front plan view of an inner pad of the padding system of FIG. 1 according to an embodiment of the present invention.
Figure 3:
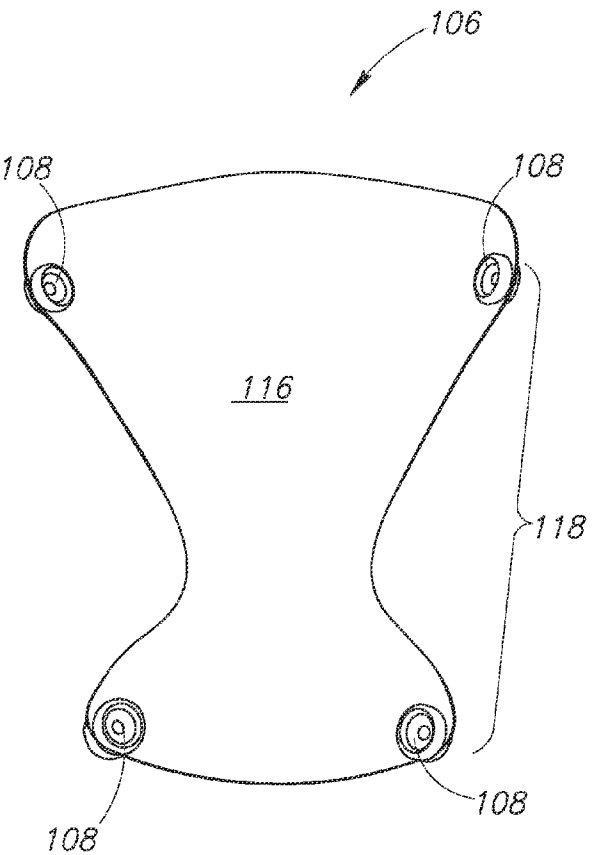
FIG. 3 is a rear plan view of an outer shell of the padding system of FIG. 1 according to an embodiment of the present invention.
Figure 5:
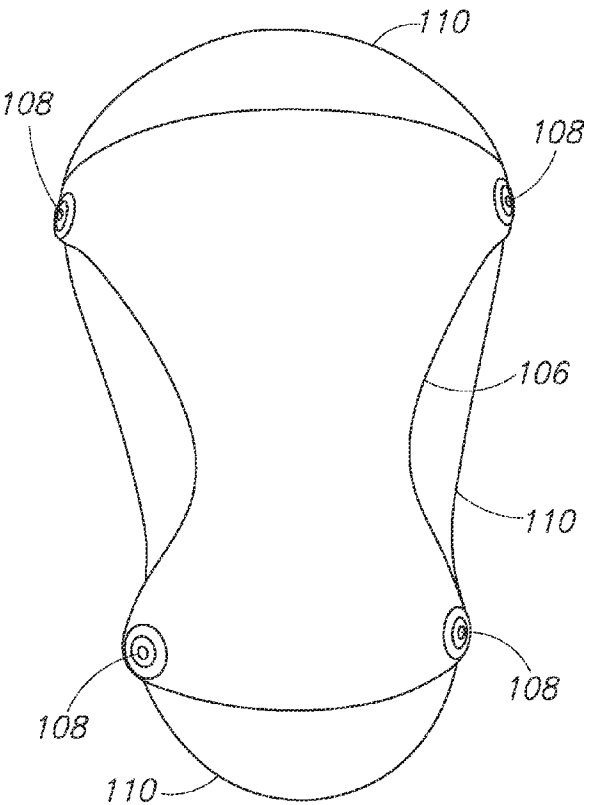
FIG. 5 is a front plan view of an the outer shell of FIG. 3 attached to the inner pad of the FIG. 4 without any apparel material therebetween according to an embodiment of the present invention.

FIGS. 3 and 4 show the outer shell 106 and inner pad 110. Referring specifically to FIG. 3, the outer shell 106 includes an inner surface 116 and an approximate hourglass shape or periphery contour 118. In the illustrated embodiment, the snap fasteners 108 are arranged adjacent the rounded corners of the contour 118, but could be arranged in a variety of configurations. Likewise, the outer shell 106 could have different shapes and/or periphery contours other than the approximate hourglass shape. Further, the snap fasteners 108 take the form of female snap fasteners, but could also take the form of male snap fasteners. The inner surface 116 includes a convex configuration for nesting with the inner pad 110 as best shown in FIG. 5. The outer shell 106 is preferably made from a hard or semi-rigid plastic material, but may be made from a variety of materials, whether rigid or flexible.

Briefly referring to FIG. 4, the inner pad 110 includes complementary fasteners 120, which in the illustrated embodiment take the form of male snap fasteners, but could also take the form of female snap fasteners. The inner pad 110 also includes an outer surface 122 and an approximate hourglass shape 124, but less pronounced than that of the outer shell 106. The outer surface 122 is concave and configured to nest with the inner surface 116 of the outer shell 106. The inner pad 110 is made from open or closed cell foam, but closed cell foam is preferable for preventing unwanted moisture absorption. The inner 110 may be made from other flexible materials that are easily bendable, yet spring back to their shape 124 when inserted into the pocket 114 (FIG. 2).

Figure 6:
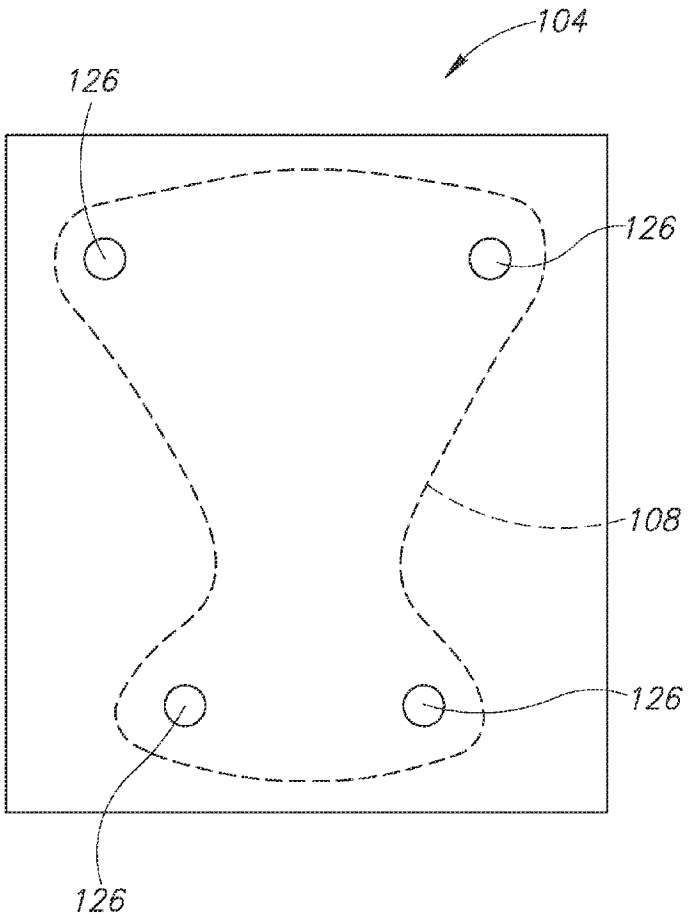
FIG. 6 is a front plan view of a knee portion of a trouser leg having openings that permit the outer to be coupled to the inner pad of the padding system according to an embodiment of the present invention.

FIG. 6 shows the knee portion 104 with openings 126 for the outer shell 108, which in turn is shown in dashed lines as merely projected onto the knee portion 104 for illustrative reference purposes. In the illustrated embodiment, the openings 126 are sized to closely receive the mating fasteners 108 (FIG. 3) and 120 (FIG. 4), respectively. Preferably, when the outer shell 106 is coupled to the inner pad 110, the openings 126 are covered by the outer shell 106.

Figure 7:
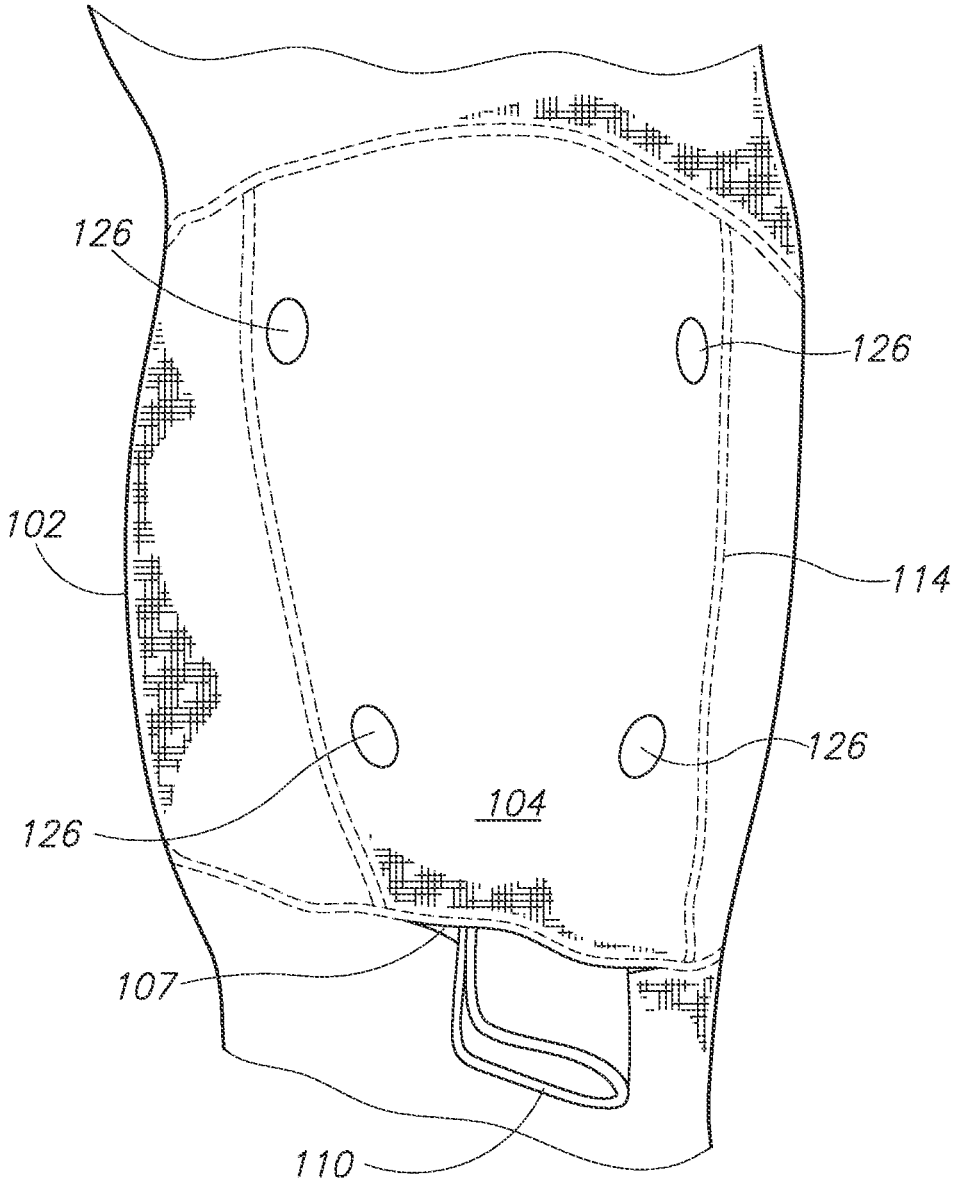
FIG. 7 is a front perspective view of an apparel item with a pocket having an opening configured to receive an inner pad according to an embodiment of the present invention.

FIG. 7 shows the inner pad 110 being inserted into the pocket 114 through the pocket opening 107. Preferably, the inner pad 110 is rolled, folded, or partially folded to fit within the pocket 114 because a maximum width of the inner pad 110 exceeds a width of the pocket opening 107. Once in the pocket 114, the inner pad 110 springs back to its unrolled or unfolded shape and may be maneuvered by hand to align with the openings 126.

Figure 8:
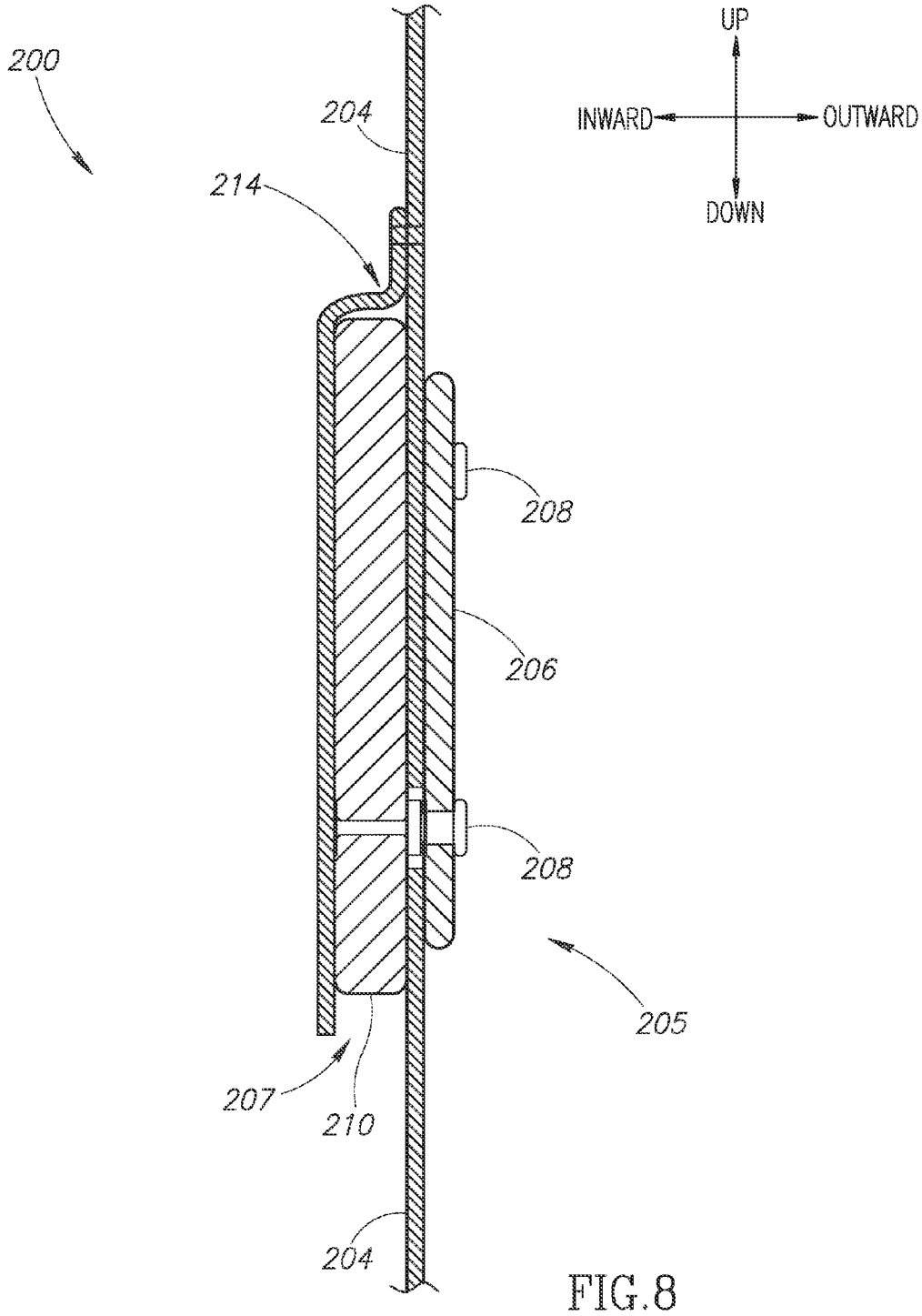
FIG. 8 is a cross-sectional view of a padding system with an inner pad received in an inner pocket and an outer shell coupled to the inner pad according to another embodiment of the present invention.

FIG. 8 shows a trouser leg 200 having a knee portion 204 and a padding system 205. Similar or identical features will retain the same reference numerals as the previous embodiment and merely be incremented by one hundred, but will not be described again in detail. An outer shell 206 is fastened to an inner pad 210 with fasteners 208. A pocket 214 extends inward from the knee portion 204 instead of outward as illustrated in FIG. 2. The pocket 214 includes a pocket opening 207 near a bottom region of the knee portion 204. The pocket opening 207 may be closed with hook and loop fasteners, snaps, or buttons to better secure the pad and prevent debris or dirt from entering the pocket 214. The opening 207 may take the form of a flap that covers the ingress region of the pocket 214. Moreover, other fastening, closing, and covering systems may be employed.

Figure 9:
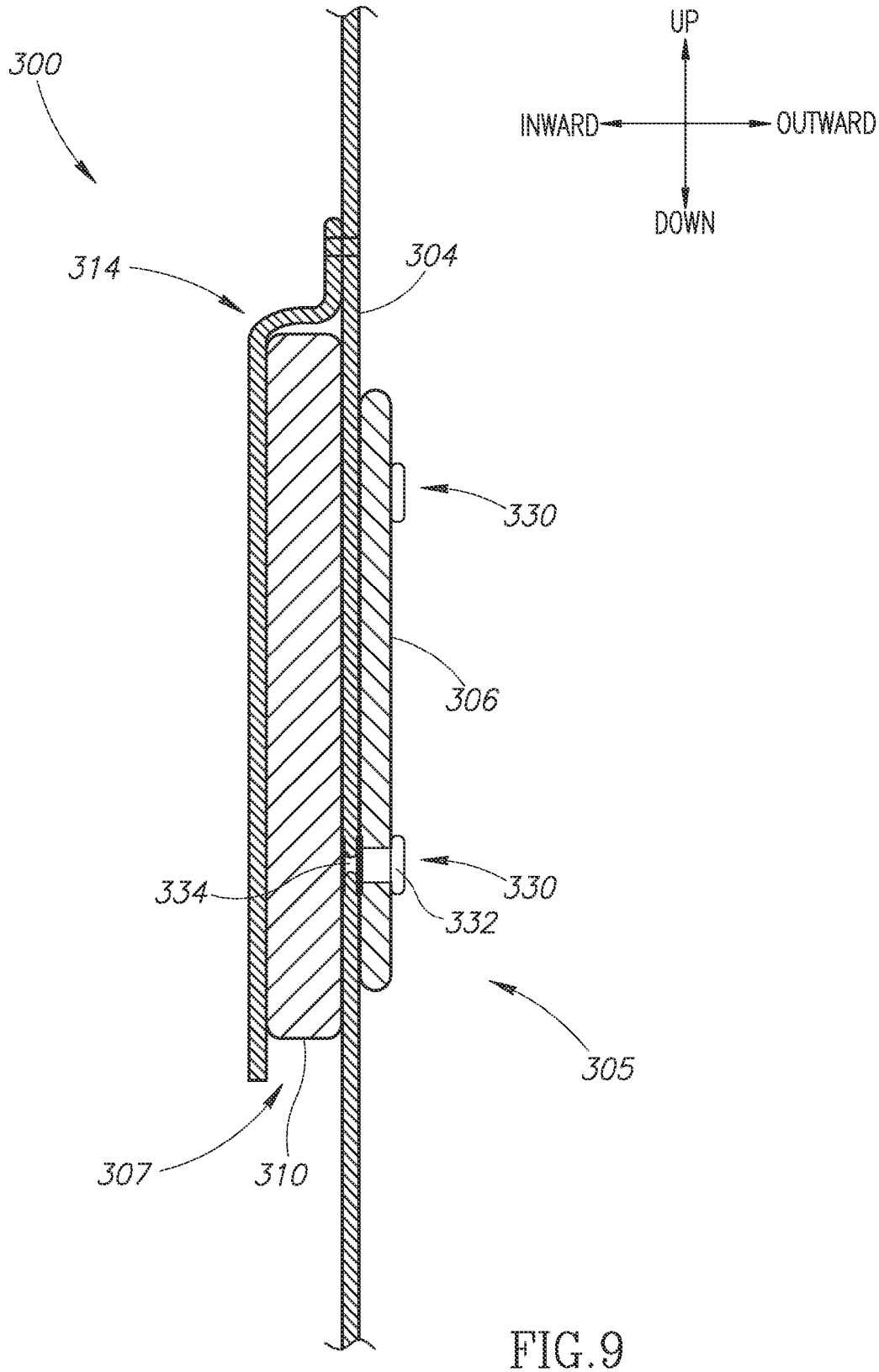
FIG. 9 is a cross-sectional view of a padding system with an inner pad received in a pocket and an outer shell coupled to an apparel item according to another embodiment of the present invention.

FIG. 9 shows a trouser leg 300 with a knee portion 304 and a padding system 305. Again, similar or identical features will retain the same reference numerals as the previous embodiment and merely be incremented by one hundred, but will not be described again in detail. In the illustrated embodiment, an outer shell 306 is coupled directly to the knee portion 304 with a fastener system 330. Thus, the outer shell 306 may have fasteners 332 that take the form of male snaps whereas the knee portion 304 may have crimped on fasteners 334 that take the form of female snaps. However, other types of fastener systems 330, such as hook and loop fastener systems, may be employed. The inner pad 310 is received into a pocket 314 in a folded manner and then expands within the pocket 314 to prevent it from falling out. It is appreciated that a pocket opening 307 may be located on the side or top of the pocket 314.

Figure 10:
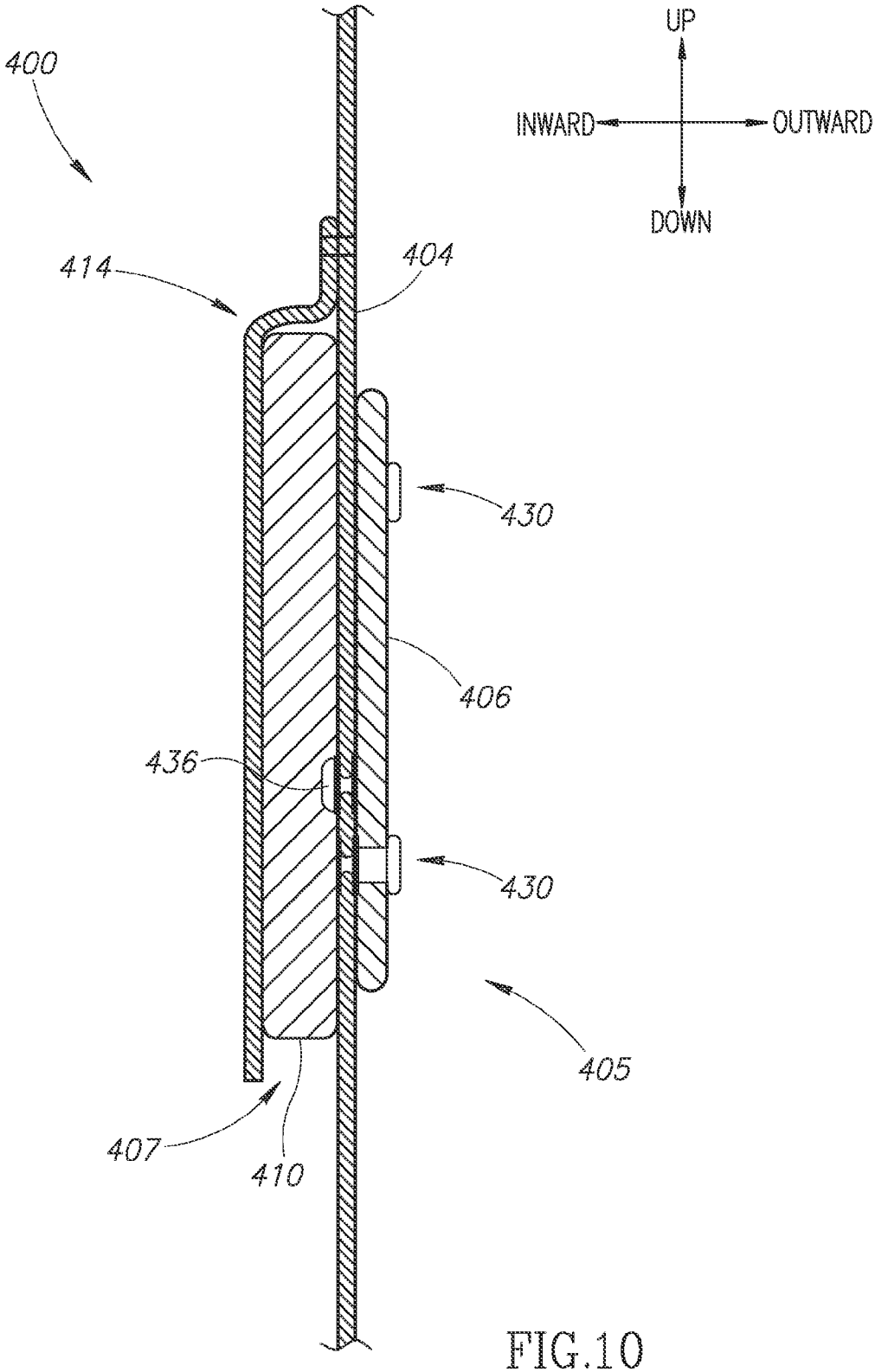
FIG. 10 is a cross-sectional view of a padding system having an inner pad received in a pocket and coupled to an apparel item and an outer shell also coupled to the apparel item according to another embodiment of the present invention.

FIG. 10 shows a slightly different embodiment of a trouser leg 400 with a knee portion 404 and a padding system 405. Again, similar or identical features will retain the same reference numerals as the previous embodiment and merely be incremented by one hundred, but will not be described again in detail. In the illustrated embodiment, an outer shell 406 is coupled directly to the knee portion 404 with a first fastener system 430. In addition, an inner pad 410 is coupled to the knee portion 404 with a second fastener system 436, which may also be attached to the pocket 414. Alternatively, the pocket 414 may extend outward from the knee portion 404 and both the outer shell 406 and inner pad 410 may be fastened to the pocket 314.

Figure 11:
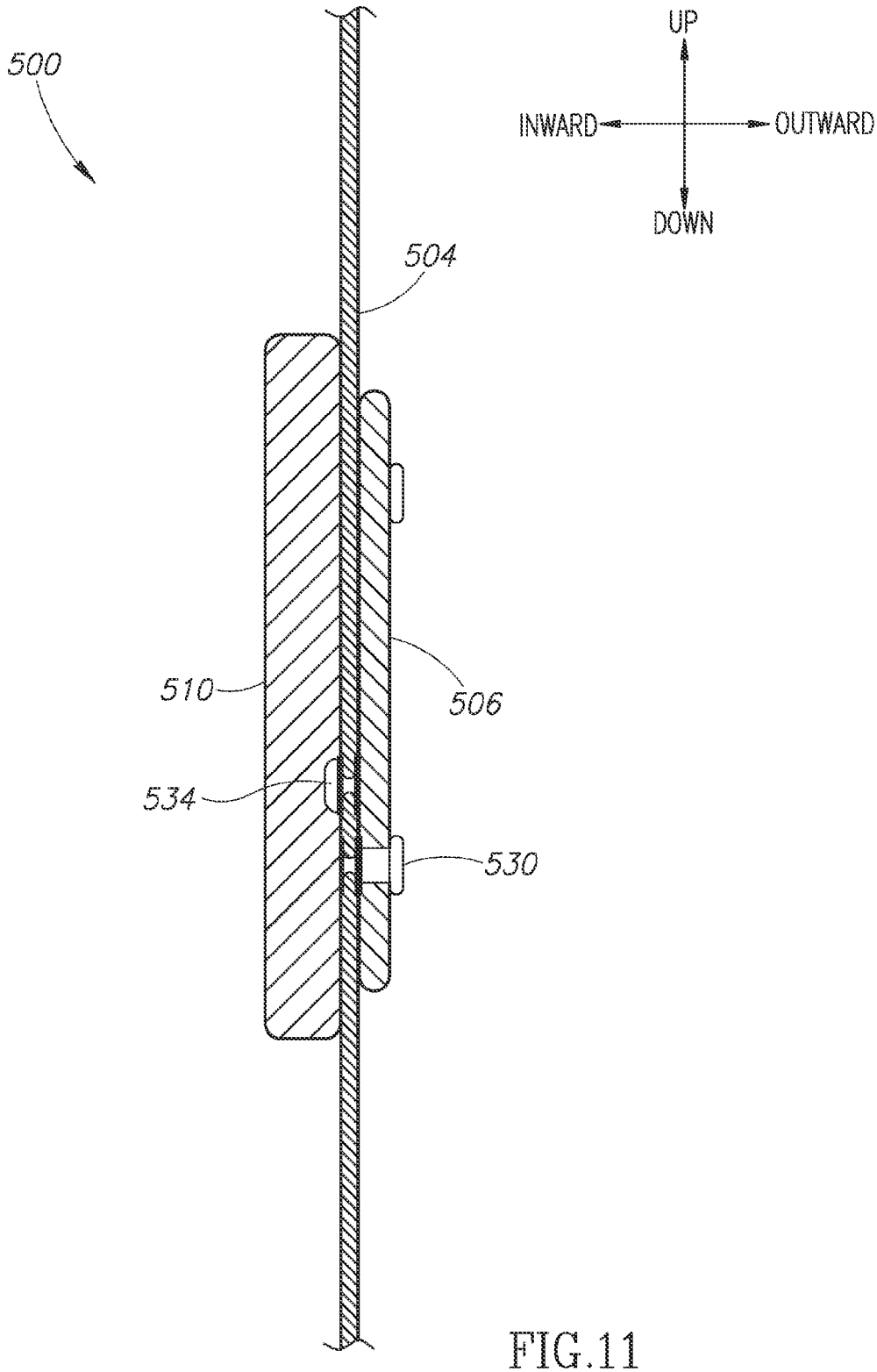
FIG. 11 is a cross-sectional view of a padding system with an inner pad not received in a pocket, but coupled to an apparel item, and an outer shell also coupled to the apparel item according to an embodiment of the present invention.

FIG. 11 shows yet another embodiment of a trouser leg 500 with a knee portion 504. In the illustrated embodiment, an outer shell 506 is attached directly to the knee portion 504 and an inner pad 510 is attached directly to the knee portion 504, but not located in any type of a pocket. The outer shell 506 and inner pad 510 may be attached with first and second fastener systems 530, 534, respectively or may be attached directly to each other through openings (not shown) in the knee portion 504.

While the preferred embodiments of the invention have been illustrated and described, as noted above, many changes can be made without departing from the spirit and scope of the invention, such as which way the pockets extend, how the shell and pad are coupled to the apparel and coupled together, whether a pocket is provided and what type of fastener systems may be utilized. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A padding system securable to a layer of apparel comprising:

an inner pad securable inside the layer;

a fastening device; and an outer shell removably attachable outside the layer and in general alignment with the inner pad, the shell being attachable to one of an apparel item or the inner pad by way of the fastening device, wherein the inner pad is fastened to the outer shell through openings provided in the apparel layer having the outer shell spanning between the openings.

2. The padding system of claim 1, wherein the inner pad is an inner knee pad.

3. The padding system of claim 1, further comprising a pocket coupled to the layer of apparel, the pocket configured to receive the inner pad.

4. The padding system of claim 1, wherein the fastening device includes fasteners arranged to enable the outer shell to be registered with respect to the inner pad.

5. The padding system of claim 1, wherein the inner pad is fastened to the apparel layer.

6. The padding system of claim 1, wherein the fastening device passes through the openings provided in the apparel layer.

7. The padding system of claim 1, wherein the fastening device includes snap fasteners.

8. The padding system of claim 1, wherein the fastening device includes hook-and-loop fasteners.

9. A padding system for an apparel item, the system comprising:

a pocket coupled to a surface of the apparel item;

an inner pad receivable in the pocket;

an outer shell removably attachable to the inner pad and the apparel item by way of openings provided in either the apparel item or the pocket the outer shell spanning between the openings.

10. The padding system of claim 9, wherein the pocket is located on an exterior-facing surface of the apparel.

11. The padding system of claim 9, wherein the pocket is located on an inner-facing surface of the apparel item and is stitched to the apparel item.

12. The padding system of claim 9, wherein the inner pad is made from a closed-cell foam material.

13. The padding system of claim 9, wherein the outer shell is made from a plastic material.

14. The padding system of claim 9, wherein an outer surface of the inner pad and an inner surface of the outer shell are complementarily contoured for nesting together.

15. The padding system of claim 9, wherein the apparel item is a trouser leg made from a cloth material.

16. The padding system of claim 9, wherein the fastener assembly passes through the openings.

17. The padding system of claim 9, wherein the openings are covered by the outer shell when attached to the inner pad.

18. A pair of trousers comprising:

a knee portion coupled to the trousers, the trousers having an interior side and an exterior side;

a pocket non-removably fastened to the knee portion on the interior side of the trousers;

an inner knee pad receivable in the pocket; and an outer shell removably attachable to the inner knee pad by way of openings provided in one of the knee portion or the pocket having the outer shell spanning between the openings.

19. The trousers of claim 18, wherein a width of an opening of the pocket is less than a maximum width of the inner knee pad.

20. A method for coupling a padding system to an apparel item, the method comprising:

sliding an inner pad into a pocket coupled to the apparel item, the inner pad having a fastening device;

arranging the inner pad in the pocket to align the fastening device with a plurality of openings formed in either one of the pocket or the apparel item; and removably coupling an outer shell to the inner pad using a complementary fastening device that is engageable with the fastening device of the inner pad and passes through the opening having a portion of one of the apparel item and the pocket positioned between the plurality of openings captured between the outer shell and inner pad, the outer shell spanning between the plurality of openings and being removable with respect to the apparel item.

* * * * *